United States Patent [19]

Sung et al.

[11] Patent Number: 4,609,377

[45] Date of Patent: Sep. 2, 1986

[54] AMINATED POLYISOPROPOXYLATED POLYETHOXYLATED ALKYLPHENOL AND ETHANOL/GASOLINE BLEND COMPOSITION CONTAINING SAME

[75] Inventors: Rodney L. Sung, Fishkill, N.Y.; Wheeler C. Crawford, Houston, Tex.

[73] Assignee: Texaco Inc., White Plains, N.Y.

[21] Appl. No.: 784,299

[22] Filed: Oct. 7, 1985

[51] Int. Cl.[4] ..... C10L 1/22

[52] U.S. Cl. ..... 44/56; 44/53; 44/72; 44/78; 252/392; 252/393; 252/148

[58] Field of Search ..... 44/53, 56, 78, 72; 252/148, 392, 393

[56] References Cited

U.S. PATENT DOCUMENTS

| | | | |
|---|---|---|---|
| 2,219,859 | 10/1940 | White | 44/56 |
| 4,207,076 | 6/1980 | Boue et al. | 44/56 |
| 4,207,077 | 6/1980 | Boue et al. | 44/56 |
| 4,252,746 | 2/1981 | Kwong | 44/72 |
| 4,444,566 | 4/1984 | Crawford et al. | 44/72 |
| 4,541,945 | 9/1985 | Anderson et al. | 252/148 |

*Primary Examiner*—Mrs. Y. Harris-Smith

*Attorney, Agent, or Firm*—Robert A. Kulason; James J. O'Loughlin; Vincent A. Mallare

[57] ABSTRACT

A novel fuel composition contains ethanol or gasohol, and, as a wear-corrosion-inhibiting additive, an aminated polyisopropoxylated polyethoxylated alkylphenol

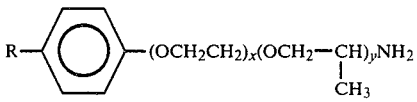

wherein R is a ($C_5$–$C_{30}$) alkyl, alkaryl, aralkyl, aryl, or cycloalkyl group, x is a numeral of about 5 to about 30, and y is a numeral of about 1 to about 20.

11 Claims, No Drawings

AMINATED POLYISOPROPOXYLATED POLYETHOXYLATED ALKYLPHENOL AND ETHANOL/GASOLINE BLEND COMPOSITION CONTAINING SAME

BACKGROUND OF THE INVENTION

This invention relates to alcohol products particularly characterized by decreased ability to corrode and wear metal surfaces with which they come into contact.

As is well known to those skilled in the art, alcohols such as ethanol may corrode metal surfaces with which they come into contact. This is particularly true of crude or commercially available ethanols which undesirably contain acidic components commonly acetic acid. In the case of fermentation alcohols, acetic acid may be present in an amount of 0.003 wt.%–0.005 wt.% of the alcohol; and this may be responsible for the fact that the alcohol causes serious corrosion and wear problems.

It is an object of this invention to provide a novel process for decreasing the corrosion and wear of alcohol compositions. Other objects will be apparent to those skilled in the art.

SUMMARY OF THE INVENTION

The novel composition of this invention may comprises (i) a major portion of a fuel containing ethanol and (ii) gasoline in an amount of 0–50 volumes per volume of ethanol; and (iii) a minor effective wear-corrosion-inhibiting amount of, as a wear-corrosion-inhibiting additive, a nonionic surfactant of an aminated polyisopropoxylated polyethoxylated alkylphenol

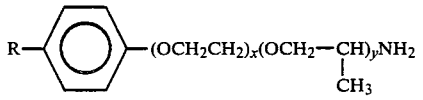

(I)

wherein R is a ($C_5$–$C_{30}$) alkyl, alkaryl, aralkyl, aryl, or cycloalkyl group, x is a numeral of about 5 to about 30, and y is a numeral of about 1 to about 20.

DESCRIPTION OF THE INVENTION

The fuel for internal combustion engines which may be treated by the process of this invention may contain (i) ethanol and (ii) gasoline in an amount of 0–50 volumes per volume of ethanol. The fuel may be an alcohol-type fuel containing little or no hydrocarbon. Commercially available mixtures may be employed. Illustrative of one such commercially available mixture may be a simulated Brazilian ethanol fuel (SBEF) having the typical analysis provided below in Table I.

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol. A typical gasohol may contain 90 volumes of gasoline and 10 volumes of SBEF.

It is preferred that the fuels to be treated by the process of this invention be substantially anhydrous, i.e., that they contain less than about 0.3 v% water; preferably from about 0.0001 v% to about 0.05 v%, and more preferably about 0.04 v% water.

It is a feature of these fuels that they may undesirably contain acidic contaminants which they cause serious corrosion and wear problems. These contaminants are particularly evident when the ethanol is commercially available and contains therein inter alia acids concurrently produced as by fermentation processes for producing ethanol or acids which have been picked up during handling. Acetic acid is a common acid present in the commercially available alcohols produced by fermentation; and it may be present in amount of 0.003 wt.%–0.005 wt.% of the total of the ethanol.

In accordance with practice of the process of this invention, there may be added to the fuel a minor wear-corrosion-inhibiting amount of, as a wear-corrosion-inhibiting additive, a nonionic surfactant of an aminated polyisopropoxylated polyethoxylated alkyphenol

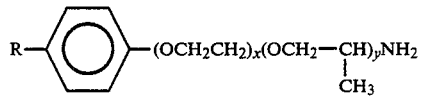

(I)

wherein R is a ($C_5$–$C_{30}$) alkyl, alkaryl, aralkyl, aryl, or cycloalkyl group, preferably a ($C_5$–$C_{12}$) alkyl group and more preferably a $C_9$ alkyl group; x is a numeral of about 1 to about 20, preferably about 1 to about 10 and more preferably about 9.5; and y is a numeral of about 1 to about 10, preferably about 1 to about 5 and more preferably about 1.

The aminated polyisopropoxylated polyethoxylated alkyphenol is available under the tradename AMINATED SURFONIC, and is manufactured by Texaco Chemical Company of Houston, Tex.

Illustrative of these compositions are those listed below in Table II, the first listed being the most preferred.

TABLE II

I. Aminated Surfonic N-95

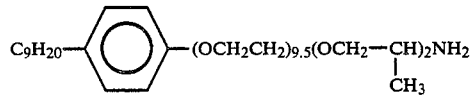

II. Aminated Surfonic N-120

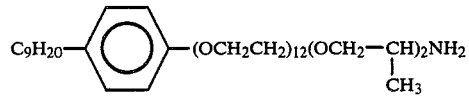

III. Aminated Surfonic N-40

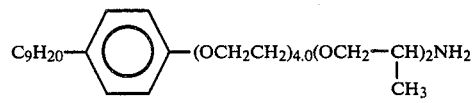

TABLE II-continued

IV. Aminated Surfonic N-10

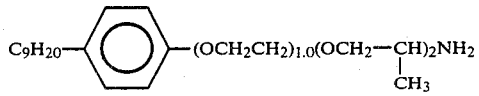

The wear-corrosion-inhibiting additives may be added to fuels (including alcohol, gasoline, gasohol, etc.) or to antifreeze. These compositions may be particularly found to be effective when added to absolute alcohol fuels typified by those available commercially containing compounds including ethers, esters, acids, etc.

The so-prepared anti-wear and anti-corrosion additives may be added to a fuel in minor wear-corrosion-inhibiting amount of about 0.003 to about 10.0 wt.% preferably about 0.01 to about 6.0 wt.%, more preferably about 0.2 to about 3.0 wt.%. Larger amounts may be employed but may not be necessary.

It is a feature of this invention that the fuel composition so prepared is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 25%–35%. A reduction of 10% is a significant reduction.

DESCRIPTION OF PREFERRED EMBODIMENTS

The means of carrying out this invention as well as the advantages thereof will be apparent to those skilled in the art from the following examples wherein, as elsewhere in this specification, all parts are parts by weight unless otherwise specified.

EXAMPLE I

A test formulation was made up containing 100% simulated Brazilian ethanol fuel containing 0.5 wt.% of the instant invention. This formulation was subjected to the four-ball test. The Average Scar Diameter was 0.34 mm.

EXAMPLE II

In this control Example, the test procedure of Example I was carried out with no additive, i.e., the medium tested was 100% simulated Brazilian ethanol fuel. The Average Scar Diameter was as shown below in Table III for Examples I and II.

TABLE III

| Example | | Average Scar Diameter mm |
|---|---|---|
| I | Animated polyisopropoxylated polyethoxylated alkylphenol | 0.34 |
| II | Simulated Brazilian fuel ethanol | 0.48 |

It is apparent that use of the preferred embodiment of this invention (Example I) desirably increased the wear-corrosion-inhibiting property of the ethanol by over 141% (0.48/0.34).

Results comparable to Example I may be obtained where there is added the polyisopropoxylated polyethoxylated alklyphenols listed below in Table IV.

TABLE IV

III. Aminated Surfonic N-95

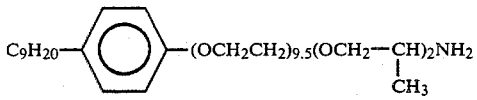

IV. Aminated Surfonic N-120

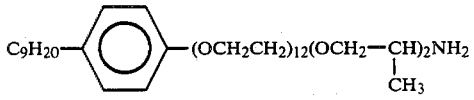

V. Aminated Surfonic N-40

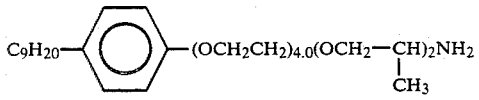

VI. Aminated Surfonic N-10

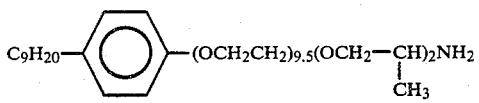

The present alkylphenols are also corrosion inhibitors which may be added to an alkanol in a minor corrosion-inhibiting amount of 0.25–25 PTB, preferably 1–200 PTB, more preferably 50–150 PTB, and most preferably about 100 PTB. (PTB stands for pounds of additive per thousand barrels of alcohol or fuel). Larger amount may be employed, but may not be necessary.

It is a feature of this invention that the alcohol composition so prepared is characterized by its increased corrosion and rust inhibition, i.e., its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled-water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 10 ml of distilled water. The bottle is shaken the sample is maintained for 3 hours at 90° F. The percent rust on the strip is determined visually. A second reading is taken after 6 days and further readings may be taken.

The inhibited alcohols of this invention, after 18 hours of the ISCT generally show a Rust and Corrosion rating below about 2–3% and frequently as low as trace-to-1%.

EXAMPLE VII

In this example, the reaction product of Example I (i.e., 100 PTB of additive) was added to 90 parts of simulated Brazilian ethanol fuel containing

| Component | Parts |
|---|---|
| ethanol | 3157.2 |
| methyl isobutyl ketone | 126.3 |
| glacial acetic acid | 0.256 |
| n-butyl alcohol | 0.24 |
| isopropyl alcohol | 0.2 |
| n-propyl alcohol | 0.162 |
| ethyl acetate | 0.2 |

Distilled water (10 parts) was then added and the system was subjected to the ISCT. The iron strip was observed after 6 days.

EXAMPLE VIII

In this control Example, the system of Example II was tested without an additive.

The results of the Iron Strip Corrosion Test were as shown below in Table V.

TABLE V

| Example | | Rust & Corrosion Rating |
|---|---|---|
| VII | Instant Invention | Trace |
| VIII | Simulated Brazilian Ethanol Fuel | 50% |

From Table V above, it is apparent that the system of Example VII, prepared in accordance with the practice of this invention showed only a trace of rust and corrosion, whereas control Example VIII showed a 50% rust and corrosion which is unsatisfactory.

EXAMPLE IX

In this example, both the fuel compositon of the instant invention as described above in Example VII, and a gasohol were subjected to the ISCT. The iron strip was observed after 30 days. The results of the ISCT were as shown below in Table VI.

TABLE VI

| Example | | Rust & Corrosion Rating |
|---|---|---|
| VII | Instant Invention | Trace |
| IX | Gasohol (10% simulated Brazilian ethanol fuel and 90% unleaded base fuel) | 5–10% |

From Table VI above, it is apparent that the system of Example VII, prepared in accordance of this invention, showed only a trace of rust and corrosion, whereas the gasohol of Example IX showed a 5–10% rust and corrosion which is unsatisfactory.

Results comparable to those of Example VII may be obtained when there is added the polyisopropoxylated polyethoxylated alkylphenols listed below in Table VII.

TABLE VII

Example

X. Aminated Surfonic N-120

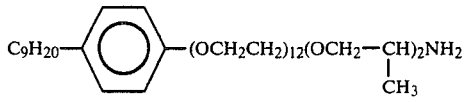

XI. Aminated Surfonic N-40

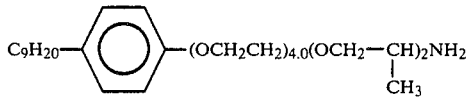

XII. Aminated Surfonic N-95

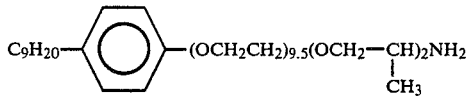

Results comparable to those of Example VI may be obtained if the fuel used is as shown below in Table VIII.

TABLE VII

| Example | Fuel |
|---|---|
| XIII | Gasohol (90 v % gasoline and 10 v % SBEF)) |
| XIV | SBEF |

Although this invention has been illustrated by reference to specific embodiments, it will be apparent to those skilled in the art that various changes and modifications may be made which clearly fall within the scope of this invention.

I claim:

1. A fuel composition for internal combustion engines comprising (a) a major portion of a fuel containing (i) ethanol and (ii) gasoline in amount of 0–50 volumes per volume of alcohol; and (b) a minor wear-corrosion-inhibiting amount of, as a wear-corrosion-inhibiting additive, nonionic surfactant of an aminated polyisopropoxylated polyethoxylated alkylphenol

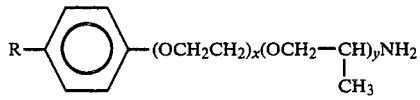

(I)

wherein R is a ($C_5$–$C_{30}$) alkyl, alkaryl, aralkyl, aryl, or cycloalkyl group, x is a numeral of about 5 to about 30, and y is a numeral of about 1 to about 20.

2. The fuel composition of claim 1, wherein said fuel is a commercial ethanol.

3. The fuel composition of claim 1, wherein said fuel is a commercial ethanol containing acid.

4. The fuel composition of claim 1, wherein said fuel is a commercial ethanol containing acetic acid.

5. The fuel composition of claim 1, wherein said fuel is a gasohol.

6. The fuel composition of claim 1, wherein said fuel is substantially anhydrous.

7. The fuel composition of claim 1, wherein said fuel contains less than 0.3 v% water.

8. The fuel composition of claim 1, wherein said amine is

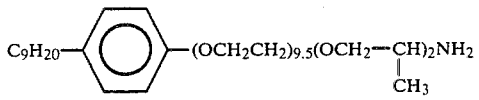

9. The fuel composition of claim 1, wherein said amine is

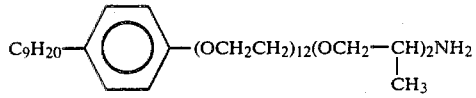

10. The fuel composition of claim 1, wherein said amine is

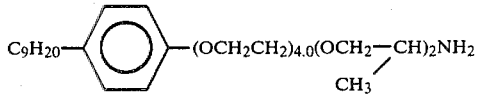

wherein y is a numeral of 1 to 2.

11. The fuel composition of claim 1, wherein said amine is

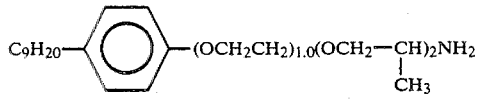

* * * * *